US007802697B2

(12) United States Patent
Martin

(10) Patent No.: US 7,802,697 B2
(45) Date of Patent: Sep. 28, 2010

(54) BOTTLE STORAGE FOR REFRIGERATOR

(75) Inventor: Christophe Martin, Sevres (FR)

(73) Assignee: Compagnie Gervais Danone, Paris (FR)

( * ) Notice: Subject to any disclaimer, the term of this patent is extended or adjusted under 35 U.S.C. 154(b) by 0 days.

(21) Appl. No.: 11/730,313

(22) Filed: Mar. 30, 2007

(65) Prior Publication Data

US 2007/0228242 A1 Oct. 4, 2007

Related U.S. Application Data

(60) Provisional application No. 60/788,111, filed on Apr. 3, 2006.

(51) Int. Cl.
*A47B 73/00* (2006.01)

(52) U.S. Cl. ..... 221/193; 221/191; 221/165; 221/74; 221/308

(58) Field of Classification Search ..... 248/317
See application file for complete search history.

(56) References Cited

U.S. PATENT DOCUMENTS

| | | | | |
|---|---|---|---|---|
| 2,772,787 | A | 12/1956 | Lee | |
| 2,880,904 | A | 4/1959 | Linthicum | |
| 3,365,068 | A | 1/1968 | Crosby | |
| 4,019,638 | A | 4/1977 | Miller | |
| 4,318,485 | A * | 3/1982 | Clement | 211/59.2 |
| 5,090,145 | A * | 2/1992 | Chiang et al. | 40/605 |
| 5,706,957 | A * | 1/1998 | Hardy | 211/59.2 |
| 5,819,937 | A | 10/1998 | Walker | |
| 6,059,125 | A * | 5/2000 | Parham | 211/59.2 |
| 6,189,734 | B1 * | 2/2001 | Apps et al. | 221/193 |

FOREIGN PATENT DOCUMENTS

| | | |
|---|---|---|
| DE | 30 39 636 | 5/1982 |
| DE | 196 04 621 | 8/1996 |
| GB | 2 158 705 | 11/1985 |

* cited by examiner

*Primary Examiner*—J. Allen Shriver, II
*Assistant Examiner*—Alaeddin Mohseni
(74) *Attorney, Agent, or Firm*—Young & Thompson

(57) ABSTRACT

A storage device for bottles with a neck, comprising at least one coupling member suitable for suspending the device beneath a shelf of a domestic refrigerator, and a hollow dispensing guide extending longitudinally from a rear end to a front end having a dispensing opening. The dispensing guide has a top face provided with the coupling member, a bottom face and a C-shaped cross section with an opening into the bottom face. The opening has a width suitable for allowing the narrowed portion of the neck of a bottle to slide freely and so that the longitudinal rims of the opening oriented toward the inside form bearing rails of a length more than twice the diameter of the widened portion of the neck of the bottle, on which this widened portion rests when the bottle is suspended.

9 Claims, 4 Drawing Sheets

BOTTLE STORAGE FOR REFRIGERATOR

The present invention relates to a storage device for bottles with a neck, comprising at least one coupling member suitable for suspending the device beneath a shelf of a domestic refrigerator.

BACKGROUND OF THE INVENTION

Domestic refrigerators are designed to contain food products contained in packages or receptacles of extremely variable shape and size. The space available in the enclosure of a domestic refrigerator being limited, there is a need for storage devices making it possible to optimize the space occupied in the refrigerator. For example, the shelves supporting the articles are usually removably mounted in rails formed at different heights in the internal walls in order to be able to adjust the spacing between two shelves. Even if it is possible thereby to reduce the space between two given shelves to store at a determined level all the small dimension products, this solution is effective only if the user has a large number of articles of a minimum size, and it is limited by the fact that the articles must remain easily accessible.

Furthermore, accessories have also been proposed with the intention of being coupled beneath the bottom face of a shelf to form locally a low-height storage zone. For example, document GB-A-2 158 705 describes a storage device having the shape of a net suspended by hooks from the rods forming a shelf and in which a bottle may be placed in a prone position. However, this device is not entirely satisfactory, particularly in the case where the user desires to store small bottles which have a height markedly less than the depth of the shelf and a diameter less than the width of a hand, because, in this case, access to a small bottle placed toward the rear end of the net is not easy.

The present invention therefore aims to propose a storage device for bottles making it possible to optimize the space occupied in a refrigerator, without however reducing accessibility to the products stored in this device.

SUMMARY OF THE INVENTION

Accordingly, the subject of the present invention is a storage device for bottles with a neck, of the aforementioned type, which comprises a hollow dispensing guide extending longitudinally from a rear end to a front end having a dispensing opening, the dispensing guide having a top radial face provided with the coupling member, a bottom radial face and a generally C-shaped cross section with an opening into the bottom face, said opening having a width suitable for allowing the narrowed portion of the neck of a bottle to slide freely and so that the longitudinal rims of the opening oriented toward the inside of said guide form bearing rails on which the top widened portion of the neck of the bottle rests when it is suspended in the device, the bearing rails having a length that is at least twice the diameter of the widened portion of the neck.

By suspending the bottles in this way by their neck, that is to say the narrowed portion situated between the main body and the top opening of the bottle, the body of the bottle remains free and can be grasped manually. The ability of the bottles to slide along the dispensing guide and through the front dispensing opening situated at the opening of the refrigerator makes it possible to guide the bottle in order to take the latter out without knocking other articles, even though it was initially stored toward the back of the refrigerator. The fact that the bottles are placed one behind the other relative to the opening of the refrigerator makes it possible to arrange a smaller or larger number of bottles depending on their diameter, in order substantially to occupy the full depth of the refrigerator. Furthermore, when no bottle is stored in the device, the usable space occupied by the latter is very small given that its height is slight relative to the height of the bottles and that it is situated close to the bottom face of a shelf. Thus, the device may remain permanently in the refrigerator without really adversely affecting the storage capacity of the latter.

It will be noted that a large number of bottles has a neck followed by a flared top portion, or a radial collar, by which they can be suspended. Specifically, virtually all plastic bottles, and consequently the large majority of bottles with a volume of less than 50 cl, have a collar for manufacturing reasons.

In preferred embodiments of the storage device, the user may also have recourse to one and/or other of the following dispositions:

- the coupling member comprises a groove suitable for being snap-fitted onto a rod of circular section forming a portion of a shelf of a refrigerator, which allows a tool-free mounting by simply pressing in the direction of the bottom face of the shelf;
- the coupling member is a single groove extending longitudinally in the top face of the dispensing guide and arranged in vertical correspondence with the center of the opening of the bottom face, so the coupling member is not dependent on the spacing between the rods of the shelf and the storage device stays naturally in a vertical position under the effect of the weight of the bottles;
- the device further comprises at least one adapter element having a connection member suitable for being connected with the coupling member of the dispensing guide, and a coupling member suitable for engaging with a shelf of a refrigerator, so as to adapt the device to various types of shelf without modifying the dispensing guide;
- the connection member of the adapter element is a rib suitable for sliding with friction in the groove forming the coupling member of the dispensing guide so as to change the position of the adapter element according to the dimensions of the shelf;
- the coupling member of the adapter element is a U-shaped hook having an opening oriented in the longitudinal direction of the dispensing guide and suitable for engaging with the edge of a shelf of a refrigerator;
- the bearing rails of the dispensing guide have, from the rear end to the front end, an inclination oriented downward when the device is mounted in a refrigerator, so that the bottles slide naturally toward the dispensing opening;
- at least one of the bearing rails has a stop close to the front end that limits the sliding of the bottles beyond this end;
- the top face of the dispensing guide is a continuous and convex surface, which prevents the accumulation of dirt on the storage device and makes cleaning easier;
- the dispensing guide has an indentation adjacent to the rear end that extends from the opening of the bottom face to the top face, in order to facilitate loading via the rear end of the guide and thereby first dispense the oldest bottles; and
- the dispensing guide is extended from its rear end by a hollow loading guide having a section similar to the dispensing guide and extending to a free end having a loading opening, said loading guide having a curvature suitable for the loading opening to be approximately oriented in the same direction as the dispensing opening so as to also deliver as a priority the oldest bottles through the dispensing opening.

BRIEF DESCRIPTION OF THE DRAWINGS

Other features and advantages of the invention will appear during the following description, given as nonlimiting examples, with reference to the appended drawings in which.

DETAILED DESCRIPTION

Figure 1:
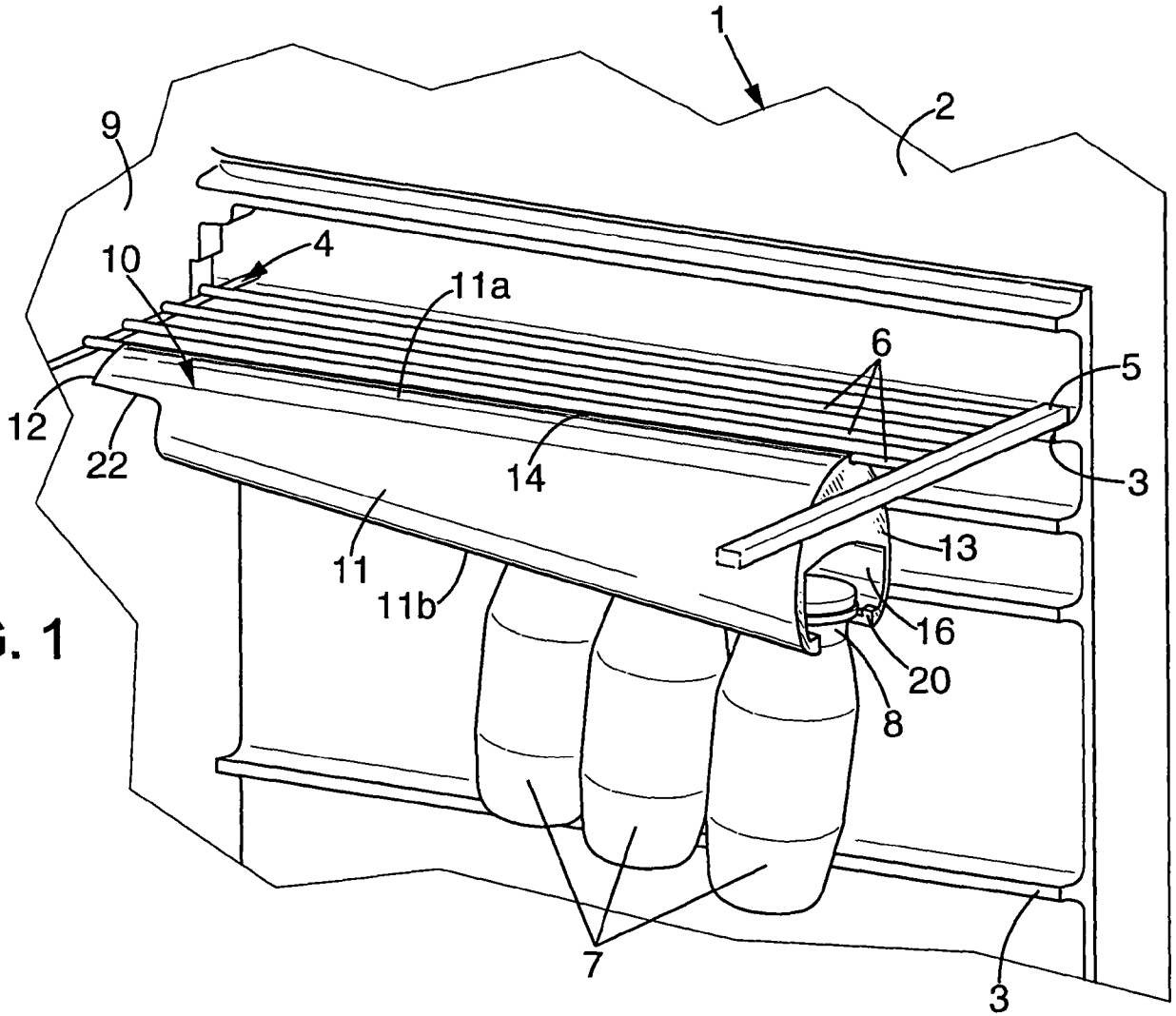
FIG. 1 is a view in perspective of a storage device according to a first preferred embodiment of the invention, that is suspended beneath a shelf of a refrigerator.

In the various figures, identical reference numerals have been retained to indicate identical or similar elements.

FIG. 1 partially represents a refrigerator 1 having, on the side walls 2 that delimit the refrigerated enclosure, horizontal rims 3 arranged at different heights. A shelf 4 rests on one pair of these rims 3. In the example represented in FIG. 1, it is a shelf formed of circular section wires or rods. The shelf 4 comprises a frame 5 and regularly spaced rods 6 that extend over the depth of the refrigerated enclosure. As is usual, the rods 6 have a circular section of a diameter of approximately 3 mm.

Bottles 7 having a neck 8 are suspended beneath the shelf 4 thanks to a storage device 10.

In the exemplary embodiment described, the bottles 7 have a capacity of approximately 10 cl, a height of 10 cm, an external diameter of approximately 3 cm at the neck 8 and of approximately 3.6 cm at the collar.

It will be noted that these small bottles whose bottom diameter is approximately equal to the diameter of the collar often pose stability problems when they are placed on the rods 6 of a shelf.

The storage device 10 comprises a dispensing guide 11 extending longitudinally from a rear end 12 situated at the back 9 of the refrigerated enclosure to a front end 13 situated close to the plane of the door frame not shown.

The dispensing guide 11 has the form of a rectilinear extrusion formed in a single piece of plastic. The length of the dispensing guide 11 is slightly less than the depth of the shelf 4, so that it extends over the majority of the depth of the refrigeration enclosure.

The dispensing guide 11 has radial faces relative to its longitudinal axis, and particularly a top radial face 11*a* that corresponds to the surface of the guide visible from above when the storage device 10 is suspended.

The dispensing guide 11 also has a bottom radial face 11*b* visible from below which, in the embodiment represented, joins the top face 11*a* due to the oval shape of the outer profile of the guide. However, the dispensing guide could have radial side faces clearly separate from the top and bottom faces if the latter had a polygonal external profile.

The top face 11*a* of the dispensing guide 11 comprises a coupling member formed by a groove 14. As can be better seen in FIG. 3, the groove 14 has a circularly arcuate profile suitable for coming into engagement with the rod 6 by snap-fitting.

The top face 11*a* forms a continuous convex surface having, in the embodiment represented, an ogival profile. Thus, if a product placed on the top face of the shelf 4 happens to run, it slides over the top face 11*a* without accumulating. Because of this continuous convex surface and because the coupling member is made in the form of a groove flush with the summit of this surface, the top face 11*a* is particularly easy to clean, which makes it possible to comply with the required hygiene conditions in a domestic refrigerator.

The dispensing guide 11 has a generally C-shaped cross section over all its length, so that the ends (12, 13) have longitudinally oriented openings, and particularly a dispensing opening 16 at the front end 13. The cross section is arranged so that the C-shaped opening opens into the bottom face 11*b* of the guide and preferably in a centered manner relative to this face. The profile of the dispensing guide 11 therefore defines an opening extending over the whole length of the guide and centered in the middle of the bottom face 11*b*. The width of this opening is adapted according to the type of bottles intended for the storage device, so as to allow the narrowed portion of the neck 8 of the bottles to slide freely, but it must be less than the diameter of the top widened portion of the neck. Thus, the longitudinal rims of the opening formed by the ends of the C-shaped section and oriented toward the inside of the guide 11 form bearing rails (17, 18) extending parallel over the length of the dispensing guide 11. As can be better seen in FIGS. 3 and 4, the widened portion of the neck of the bottles rests on the bearing rails 17 and 18 so that the bottles are suspended by their neck in the storage device 10.

In order to optimize the storage space available in the enclosure 20 of the refrigerator, the bearing rails (17, 18) extend over a length more than twice the diameter of the widened portion of the neck so that the storage device 10 can contain at least two bottles. However, the bearing rails may extend over the majority of the relatively standard depth of the refrigerated enclosure, so that a fairly large number of bottles can be stored depending on the dimensions of the latter. For example, six bottles 7 can be stored simultaneously in the dispensing guide 11.

The groove 14, forming a single coupling member, extends in a rectilinear manner over the whole length of the top face 11*a* of the dispensing guide 11. In addition, the groove 14 is centered in the middle of the top face 11*a* and consequently situated level with the center of the opening of the bottom face 11*b*, so that the storage device 10 naturally adopts a vertical position under the weight of the bottles 7. It is therefore not necessary for the coupling member formed by the groove 14 to immobilize the storage device 10 in rotation relative to the rod 6 of the shelf. The groove 14 must simply hold the guide 11 on the rod 6 while the downward tension exerted does not exceed a value markedly greater than the weight of all the bottles that the storage device 10 can receive. The groove 14 may therefore be designed so as to be coupled by snap-fitting with a fairly large clearance on the rods of the shelf whose diameter varies substantially.

Figure 4:
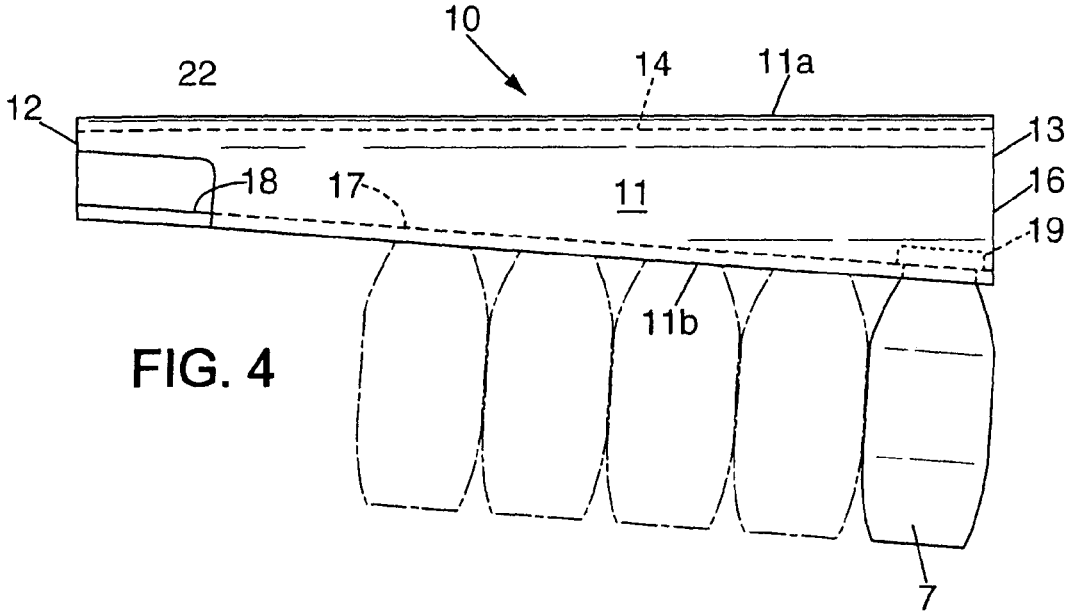
FIG. 4 is a side view of the storage device represented in FIG. 1.

It is clearly visible in FIG. 4 that the guide 11 is designed particularly according to the height of the coupling member (s) and the change in the cross section of the guide, so that the bearing rails (17, 18) have a downward inclination from the rear end to the front end. Thus, as soon as a bottle is stored in the device, it slides by gravity close to the dispensing opening 16. This makes the bottles easier to grasp.

In the embodiment described where the top face 11*a* is parallel with the horizontal rod 6 of the shelf, the inclination of the rails (17, 18) is obtained by changing the cross section of the dispensing guide 11 so as to increase its height from the rear end 12 to the front end 13 and this, mainly by increasing the thickness of the material in the central portion of the C-shaped section.

Figure 3:
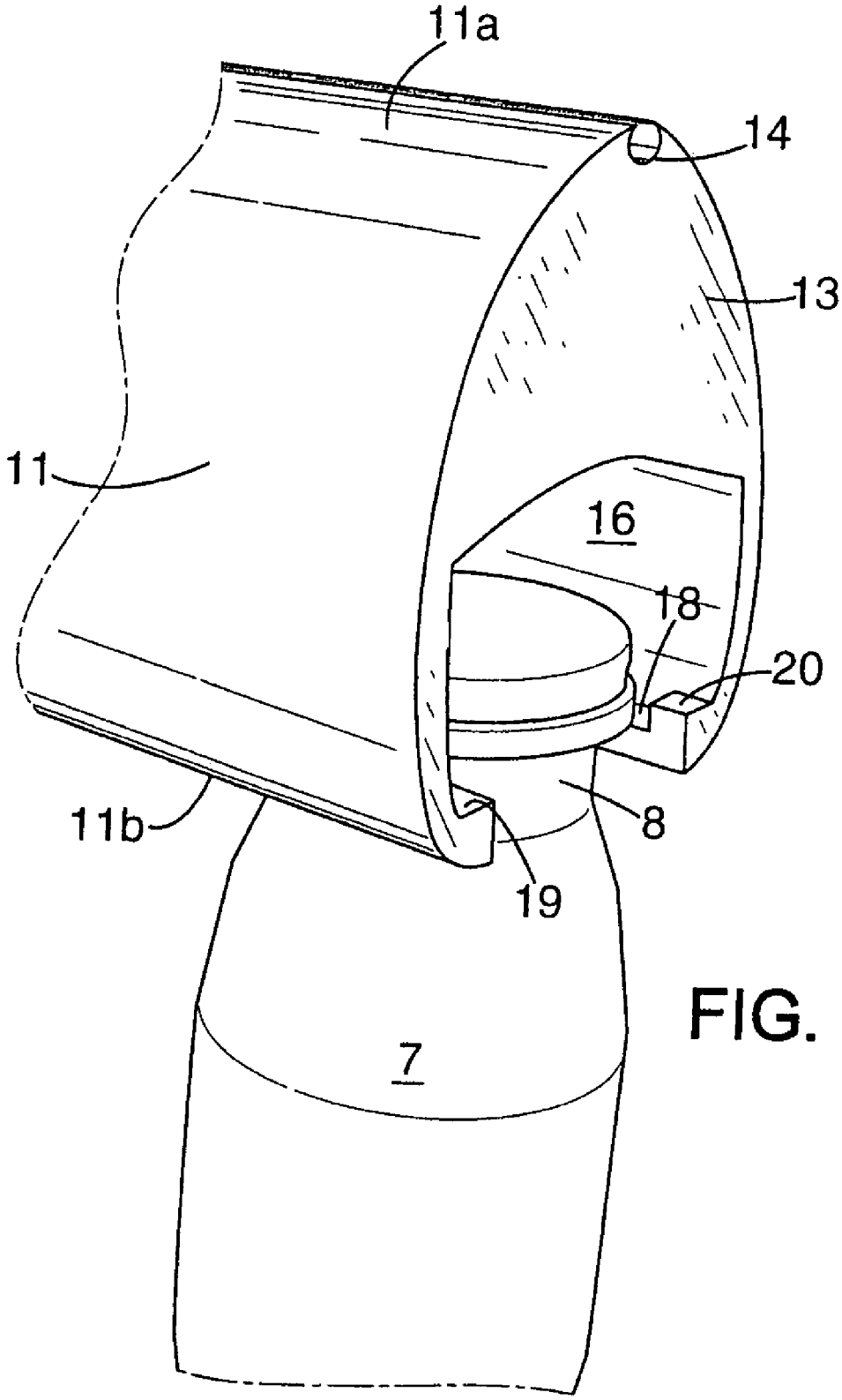
FIG. 3 is a partial enlarged view of the storage device represented in FIG. 1.

In order to prevent the bottles from falling from the front end 13, stops (19, 20) are formed on the bearing rails (17, 18) close to this end 13. As can be seen in FIG. 3, these stops (19, 20) are in the form of studs protruding upward at the end of the bearing rails (17, 18). However, these stops could be formed differently, for example in the form of an elastic lug extending from one rail to the other across the opening of the bottom face.

The dispensing guide 11 has, at its rear end, an indentation 22 that can be seen in FIG. 4. The indentation 22 extends from the opening of the bottom face 11*b*, so that the bearing rail 17 is interrupted at the level of the latter, and rises toward the top face 11*a* over a height greater than the height of the neck portion inserted into the guide 11. The length of the indentation, measured from the rear end 12 of the guide, is greater than the external diameter of the bottle 7. The indentation 22 therefore forms an opening making it possible to load bottles from the side into the guide and consequently more easily than via the rear end opening 12 that is not visible when the storage device 10 is mounted in the refrigerator.

Loading new bottles from the side of the rear end 12 has the advantage of placing the bottles that were stored first at the user's disposal at the dispensing opening 16. This allows a better management of the stock of bottles stored in the refrigerator by preventing the consumption of a bottle whose use-by date is still far off, while bottles whose use-by date is nearer are still stocked.

Figure 2:
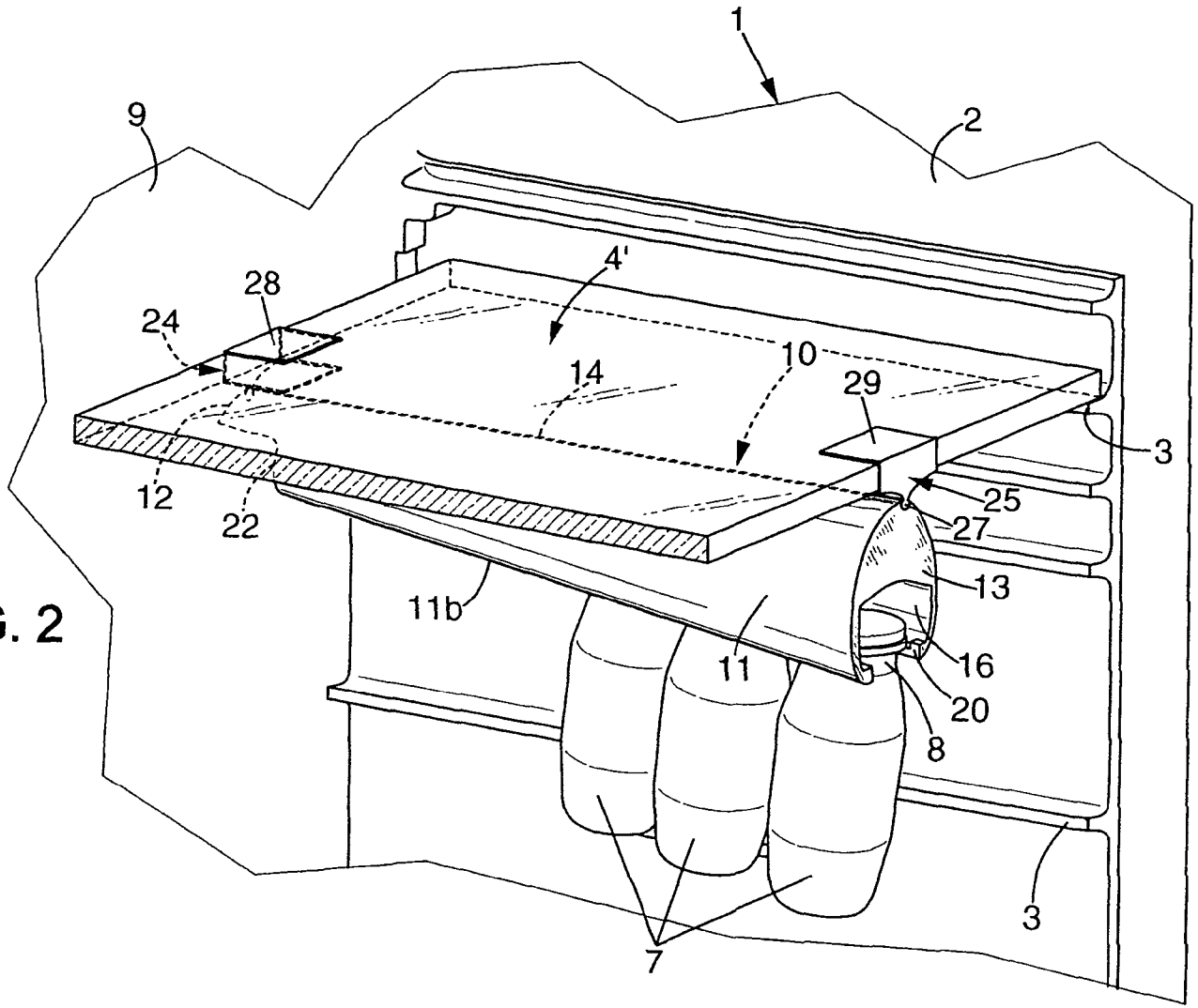
FIG. 2 is a view similar to FIG. 1 of a variant of the first embodiment comprising adapter elements.

In a variant of this first embodiment represented in FIG. 2, adapter elements (24, 25) are provided between the dispensing guide 11 and the shelf 4' that is shown here in the form of a glass plate.

The adapter elements (24, 25) each comprise a connection member 27 that is presented in the form of a rib having an omega-shaped profile suitable for being inserted into the groove 14 of the dispensing guide 11 and a coupling member (28, 29) presented in the form of a U-shaped hook that is suitable for coming into engagement with the edge of the shelf 4'.

The connection member 27 of each of the adapter elements (24, 25) is preferably shaped to be able to slide with friction in the groove 14, so as to insert the U-shaped opening of the coupling members (28, 29) by sliding the adapter element and so as to adjust the position of these adapter elements according to the depth of the shelf 4'. However, the shape of the connection member and that of the coupling member of the adapter elements could be substantially different, particularly according to the configuration of the coupling member(s) of the dispensing guide 11 and the structure of the shelf. Furthermore, it is possible to provide only one adapter element, if the latter's only function is to adjust the position of the second coupling member, formed by the adapter element according to the depth of the shelf, or of the distance separating the rods of a shelf.

Figure 5:
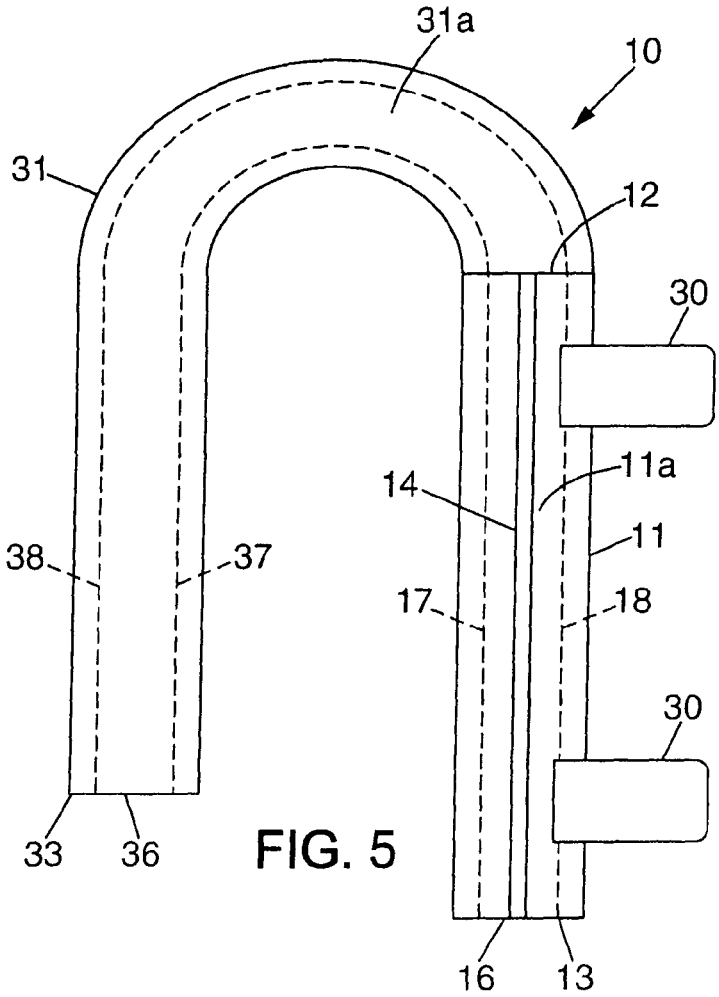
FIG. 5 is a top view of a storage device according to a second embodiment of the invention.

FIG. 5 represents a second embodiment of the storage device 10 that comprises a dispensing guide 11 extending from a rear end 12 to a front end 13. This dispensing guide 11 is similar to the dispensing guide of the first embodiment. It has in particular a generally C-shaped cross section that defines an opening in the bottom face and bearing rails (17, 18) represented in dashed lines, and a groove 14 that forms a coupling member at the summit of the top face 11*a*. The bearing rails (17, 18) may be inclined as in the first embodiment or be horizontal, but no indentation at the rear end 12 is provided for the loading of the bottles. Furthermore, in this embodiment, the dispensing guide 11 has two bearing lugs 30 extending laterally from a side of the guide 11, whose function will be detailed below.

The dispensing guide 11 is extended from its rear open end 12 by a loading guide 31 that extends first in an arc of a circle then in a rectilinear manner to a free end 32, called the loading end. The loading guide 31 has a cross section similar to that of the dispensing guide 11, that is to say generally C-shaped and satisfying the same requirements with respect to the dimensions of the bottles.

The loading guide 31 has, at its free end 32, an end opening 36, called the loading opening, and bearing rails (37, 38) that are connected and extend the bearing rails (17, 18) of the dispensing guide 11. More particularly, at the rear end 12 of the dispensing guide 11, the two guides (11, 31) have an identical section so as to form continuous outer and inner surfaces. However, the loading guide 31 has, at the summit of its top face 31*a*, a crank with the top face 11*a* at the rear end 12, so that the top face 31*a* of the loading guide 31 is situated just below the level of the bottom of the coupling groove 14.

Thus formed, the storage device 10 is generally U-shaped and has a loading opening 36 at the end of one branch of the U and a dispensing opening 16 at the end of the other branch of the U. As in the case of loading from the side of the rear end 12 in the first embodiment, the purpose of this is to make it easier to comply with the freshness dates of the products by storing the bottles 7 in the device 10 via the loading opening 36 and taking out the bottles to be consumed via the dispensing opening 16, particularly when the bottles 7 contain a milky product that can perish rapidly. However, in this second embodiment, loading is again made easy because the loading opening 36 and the dispensing opening 16 are both oriented toward the opening of the refrigeration enclosure, that is to say toward the user.

It will be noted that the branch of the U forming part of the loading guide 31 does not necessarily have the same length as that of the dispensing guide 11. On the contrary, as represented in FIG. 5, this branch is shorter so that the user immediately identifies the loading opening 36 and the dispensing opening 16 and he is encouraged to take out the bottles at the dispensing opening 16. It may even be envisaged that the loading guide 31 comprises only one curved section so that the loading opening 36 is oriented like, or approximately like, the dispensing opening, but substantially at the rear end 12 of the dispensing guide 11.

Just like the first embodiment, the dispensing guide 11 comprises a single coupling groove 14 that can be snap-fitted onto a rod 6 of a shelf, or into which adapter elements (24, 25) can be inserted. Furthermore, the bearing lugs 30 have top faces that extend on the side opposite to the loading guide 31 in a horizontal plane situated slightly below the bottom of the groove 14, so as to press on another rod 6 of the shelf 4 and prevent the storage device 10 from tipping.

Just like the first embodiment, the storage device comprising the dispensing guide 11 and the loading guide 31 may be made in a single plastic piece to reduce its cost.

To install the storage device 10, made according to one or other of the embodiments, the user places the groove 14 of the dispensing guide under the rod 6 of a shelf 4 if the latter is made of wire, and snap-fits the device by applying an upward pressure. In the case of a shelf 4' being in the form of a plate, for example made of glass, the user fits a first adapter element 24 at the rear end of the groove 14 and couples the coupling member 28 of the first adapter element 24 with the rear edge of the shelf 4'. Then, he installs a second adapter element 25 while engaging by translation the connection member 27 of the second adapter element 25 into the groove 14 of the dispensing guide and the coupling member 29 of the second adapter element 25 with the front edge of the shelf 4'.

The user inserts the bottles 7 into the storage device 10, preferably via the rear end 12 of the dispensing guide 11, or via the indentation 22 or else the loading opening 36 if the latter are provided. However, it is perfectly possible to insert the bottles via the dispensing opening 16, particularly if the storage device 10 was previously empty.

To consume a bottle 7, the user grasps the body of the bottle situated at the dispensing opening 16 that is normally situated close to the opening plane of the refrigerated enclosure, and removes the bottle from the dispensing guide by making a slight upward movement to pass over the stops (19, 20). The storage device 10 thus produced is practical to use, makes it possible to use refrigerator space that is often unoccupied, solves the problems of stability on the wire shelves of certain small-sized bottles and makes it possible to give priority to consuming the products whose use-by date is the closest, all this while being economical and complying with the hygiene conditions relating to domestic usage.

Naturally, the two embodiments described above are in no way limiting, and it is in particular possible to combine various features of these embodiments without departing from the context of the present invention.

What is claimed is:

1. A storage device for bottles with a neck, comprising:

a hollow dispensing guide, extending longitudinally from a rear end to a front end and having a dispensing opening, said dispensing guide having a top radial face provided with a coupling member, a bottom radial face, and a generally C-shaped cross section with an opening into said bottom face, and said opening having a width configured to allow the narrowed portion of the neck of a bottle to slide freely, and having longitudinal rims oriented toward the inside of said dispensing guide, the longitudinal rims forming bearing rails configured such that a top widened portion of the neck of the bottle rests on said bearing rails when the bottle is suspended in the storage device, said bearing rails having a length more than twice the diameter of the widened portion of the neck; and at least one adapter element, having i) a connection member insertable into said coupling member of the dispensing guide and ii) an engagement member configured to engage with the shelf of said refrigerator, wherein said coupling member is formed as a groove having an opening oriented upwardly and configured to be snap-fitted onto the connection member of the adapter element, wherein said top face of the dispensing guide is a continuous and convex surface, and wherein the opening of the groove is situated in the surface of the top face.

2. The storage device as claimed in claim 1, wherein said coupling member is a single groove extending longitudinally in said top face of the dispensing guide and arranged in vertical correspondence with the center of said opening of the bottom face.

3. The storage device as claimed in claim 1, wherein said connection member of the adapter element is a rib configured to slide with friction in said groove of the coupling member.

4. The storage device as claimed in claim 1, wherein said coupling member of the adapter element is a U-shaped hook having an opening oriented in a longitudinal direction of said dispensing guide, and wherein said coupling member is configured to engage with an edge of said shelf of a refrigerator.

5. The storage device as claimed in claim 1, wherein said bearing rails of the dispensing guide have, from the rear end to the front end, an inclination oriented downward when said storage device is mounted in a refrigerator.

6. The storage device as claimed in claim 1, wherein at least one of said bearing rails has a stop proximate to said front end, the stop configured to limit the bottles from sliding beyond said front end.

7. The storage device as claimed in claim 1, wherein said dispensing guide has an indentation adjacent to said rear end, the indentation extending from said opening of the bottom face to said top face.

8. The storage device as claimed in claim 1, further comprising:

a hollow loading guide extending from said rear end and having a section extending to a free end having a loading opening, said section being similar to said dispensing guide, and said loading guide having a curvature configured such that the loading opening is approximately oriented in a same direction as the dispensing opening.

9. The storage device as claimed in claim 1, wherein said groove extends along an entire longitudinal length of said top radial face of said dispensing guide from the rear end to the front end.

* * * * *